United States Patent [19]

Murasaki

[11] 3,978,895

[45] Sept. 7, 1976

[54] DRIVING MECHANISM FOR SELVAGE FORMING KNITTING NEEDLE IN SHUTTLELESS LOOM

[75] Inventor: Ryuichi Murasaki, Tateyama, Japan

[73] Assignee: Yoshida Kogyo Kabushiki Kaisha, Japan

[22] Filed: Dec. 24, 1975

[21] Appl. No.: 644,152

[30] Foreign Application Priority Data

Dec. 28, 1974 Japan ..... 50-1890

[52] U.S. Cl. ..... 139/431

[51] Int. Cl.[2] ..... D03D 47/42

[58] Field of Search ..... 139/431, 432

[56] References Cited

UNITED STATES PATENTS

| | | | |
|---|---|---|---|
| 3,752,195 | 8/1973 | Libby | 139/431 |
| 3,788,361 | 1/1974 | Kronoff et al. | 139/431 |

FOREIGN PATENTS OR APPLICATIONS

| | | | |
|---|---|---|---|
| 2,048,543 | 4/1971 | Germany | 139/431 |

*Primary Examiner*—Henry S. Jaudon
*Attorney, Agent, or Firm*—Bucknam and Archer

[57] ABSTRACT

A driving mechanism for selvage forming knitting needles in shuttleless looms is a linkage comprising a pair of upper and lower horizontal links and a pair of front and rear vertical links, these links being pivotally joined togehter to provide a substantially parallelogramatic construction. A first link extension extends from the lower link and is pivotally coupled to a machine frame. A second link extension extends from the upper link and has mounted thereon a knitting needle which is provided with a hook and a shank and is located alongside of the fabric. A disk crank has a crank pin rotatably connected to the rear link and is coupled with a drive shaft of the shuttleless loom. Rotating the disk crank swings the links so that the knitting needle is movable between a first position where the hook is raised to engage a loop of weft yarn projected through the shed and a second position where the shank is held vertically stationary adjacent to the fabric fell to knit the loop through the previous loop on the shank.

7 Claims, 4 Drawing Figures

DRIVING MECHANISM FOR SELVAGE FORMING KNITTING NEEDLE IN SHUTTLELESS LOOM

BACKGROUND OF THE INVENTION

1. Field of the Invention

This invention relates generally to shuttleless looms and more particularly to a driving mechanism for selvage forming knitting needles in shuttleless looms.

2. Prior Art

Shuttleless looms have been known in which loops of weft yarn are successively inserted into the warp sheds by means of a weft inserting finger and are interknitted at one edge of the fabric by a selvage forming knitting needle. In looms of this type, both the weft inserting finger and the knitting needle perform a reciprocating motion in one plane and cross each other where the successive weft loops are interknitted in an extremely short period of time, when the knitting needle tends to miss the next loop of weft yarn. One solution to the above problem has been to move the knitting needle up and down to ensure that the knitting needle engage the weft thread without fail.

For example, an attempt has been made to cause the knitting needle to follow an arcuate or a substantially arcuate path during its back-and-forth reciprocating movement, which path lies in a vertical plane extending in a crisscross relation to a horizontal plane in which the weft inserting finger sweeps through the warp shed. This attempt has avoided the missing of the next loop of weft yarn but has produced a relatively large and loose knitted selvage, since the previous loop which remains engaged on the shank of the knitting needle moves also up and down and becomes enlarged at a position adjacent to the fell of the fabric on account of the arcuate movement of the knitting needle.

It has been therefore been suggested that the knitting needle be arranged to perform a substantially straight motion near the fell, without preventing the engagement of the ensuing weft loop with the knitting needle. One such attempt has been to arrange the knitting needle in order to carry out a combined arcuate and substantially straight motion so that the up-and-down movement of the needle shank near the fell will be held to a minimum during the reciprocating motion of the knitting needle. Another attempt has employed a mechanism whereby the advancing movement of the knitting needle can be effected in a path different from that in which its retracting movement is effected in order to minimize the up-and-down movement of the needle shank adjacent to the fabric fell.

With these prior attempts, however, the needle shank is still prone to move up and down during its reciprocation and, in addition, the power transmission mechanism must be equipped with a slide member for reciprocating the knitting needle. This slide member itself causes an additional problem in that the loops of weft yarn are susceptible to missing by the knitting needle because the slide member gets worn during its reciprocating movement and cannot move accurately where desired. Furthermore, the slide member must be supplied with an oil to provide proper lubrication which oil then tends to be scattered about and deposited on the yarns and the fabric which is being woven. The slide member presents still another difficulty in that the slide member, being in most cases located adjacent to the fabric fell, takes up space and makes it difficult to adjust the position of, or replace the knitting needle and to thread the weft inserting finger and the reed.

SUMMARY OF THE INVENTION

It is a primary object of this invention to provide a driving mechanism for a selvage forming knitting needle in a shuttleless loom, which mechanism will eliminate the above-noted various difficulties.

It is another object of this invention to provide a driving mechanism of the described type which will move the knitting needle a sufficient distance to catch each weft loop positively and at the same time, prevent the needle from moving up and down alongside of the fell of the fabric which is being woven, thereby producing a tightly knitted selvage.

Still another object of the invention is to provide a driving mechanism of the described type which is simple in construction and durable for high speed operation.

According to the invention, there is provided a linkage mechanism comprising a pair of upper and lower horizontal links and a pair of front and rear vertical links, these links being pivotally joined together to provide a substantially parallelogramatic construction. A first link extension extends from the lower link and is pivotally coupled to a machine frame. A second link extension extends from the upper link and has mounted thereon a knitting needle which is provided with a hook and a shank and is located alongside of the fabric. A disk crank has a crank pin rotatably connected to the rear link and is coupled with a drive shaft of the shuttleless loom. Rotating the disk crank swings the links so that the knitting needle is movable between a first position where the hook is raised to engage a loop of weft yarn coming through the shed and a second position where the shank is held vertically stationary adjacent to the fabric fell to knit the loop through the preceding loop on the shank.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
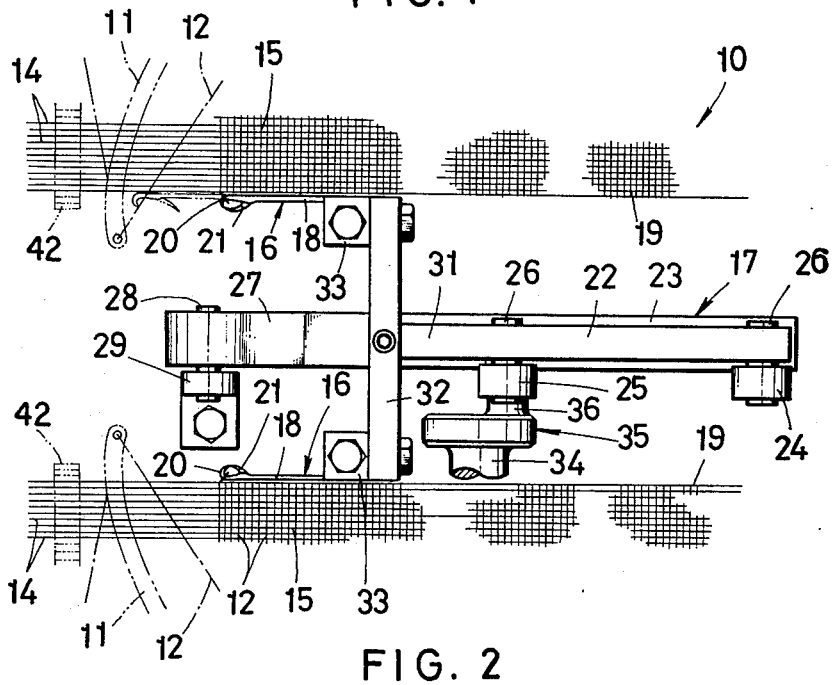
FIG. 1 is a plan view of a driving mechanism constructed in accordance with the invention.

FIG. 1, the apparatus of the present invention is shown as employed in a needle loom 10 of the type which produces simultaneously a pair of narrow webs especially for use as slide fastener tapes. The needle loom 10 generally comprises a pair of weft inserting fingers 11 for inserting loops of weft yarns 12 into successive sheds 13 of warp yarns 14 to produce a pair of narrow webs 15, and a pair of knitting needles 16 each held in a position alongside of the web 15 and operated by a driving mechanism 17 to move between a first position where the needle 16 catches each loop projected through the shed 13 by the finger 11 and a second position where the needle 16 knits this loop through the previously caught loop which is then cast off a shank 18 of the needle 16, thereby producing a looped or knitted selvage 19. The type of the knitting needles 16 shown on the drawing is a latch needle having a hook 20 and a latch 21 provided to the shank 18.

A pair of reeds 42 are provided to beat up the loops of weft yarns 12 inserted in the sheds 13. The needle loom 10 further includes a device for successively forming the sheds 13 of the warp yarns 14, a feed device for feeding the warp yarns 14 from a suitable yarn supply as the weaving operation progresses, and a winding device for winding the produced webs 15. These devices are not shown for the clarity of illustration but are well known in the art.

Figure 2:
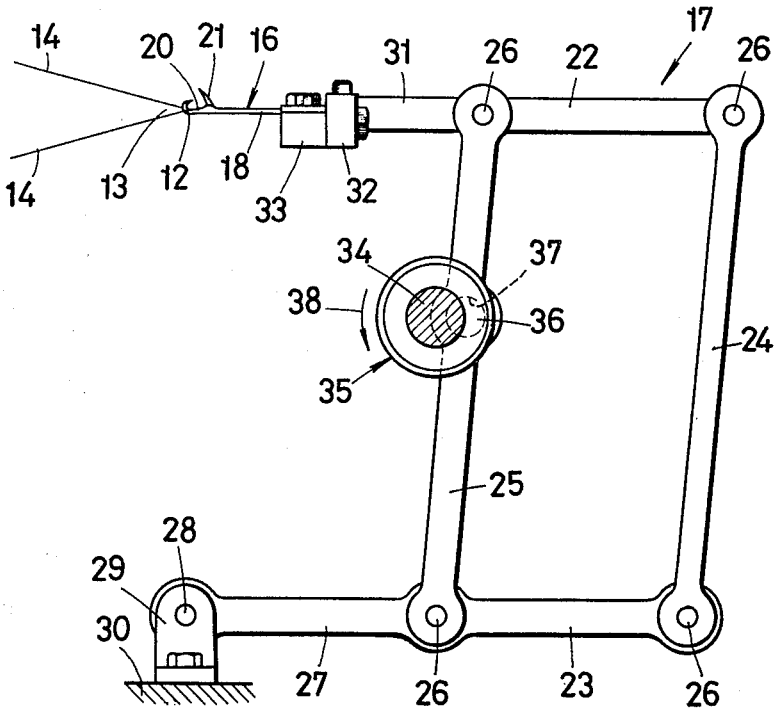
FIG. 2 is a side elevation view of the drawing mechanism shown in FIG. 1.

The driving mechansim 17 is a linkage comprising a pair of upper and lower horizontal links 22, 23 and a pair of front and rear vertical links 24, 25, all links being joined pivotally together at their ends by pins 26 to provide a substantially parallelogramatic construction when viewed in side elevation as shown in FIG. 2. The lower horizontal link 23 has at one end a first link extension 17 extending rearwardly away from the front vertical link 24 and pivotally coupled at its free end by a pin 28 with a support bracket 29 which in turn is bolted to a machine frame 30. The upper horizontal link 22 has at one end a second link extension 31 extending rearwardly away from the front vertical link 24 and having at its free end an elongated needle carrier 32 extending at right angles to the link extension 31.

The needle carrier 32 has its center supported on the link extension 31 and is provided at both ends with a pair of needle holders 33 on which the knitting needles 16 are mounted. A drive shaft 34 has at its free end a disk crank 35 with a crank pin 36 fixed thereto and rotatably fitted in a hole 37 formed in a central portion of the rear vertical link 25. The crank pin 36 however may be rotatably coupled to the front link 24 or the upper link 22, as necessary.

Figure 3A:
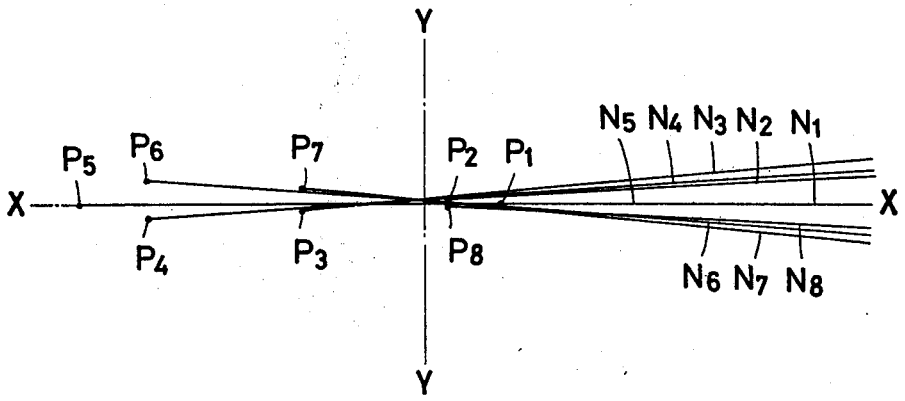
FIGS. 3A and 3B are schematic views each explanatory of the way in which the shank and hook of the knitting needle are moved during one cycle of operation of the mechanism.
Figure 3B:
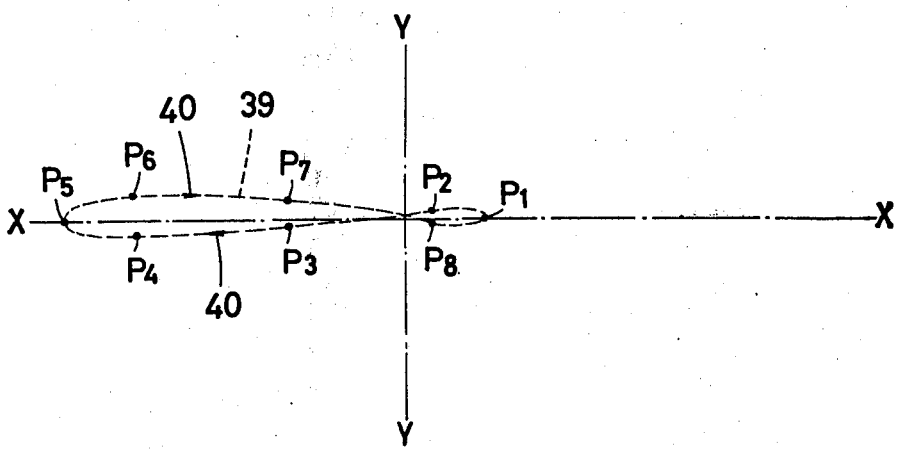

The lengths of the links and extensions, and the position where these link members are interconnected, are so selected that when the drive shaft 34 is rotated to swing the rear link 25 through the crank pin 36, the overall linkage mechanism 17 is actuated to move the knitting needles 16 back and forth and concurrently up and down, as will be described below with reference to FIGS. 3A and 3B. In FIGS. 3A and 3B, line X—X indicates the level of the narrow webs 15 and line Y—Y the position of the fabric fell.

When the drive shaft 34 starts rotating counterclockwise or in the direction of the arrow 38 from the position shown in FIG. 2, the crank pin 36 moves the rear and front links 25, 24 which then jointly serve to move the upper link 22 so that the needle hook 20 will move past the positions P1 through P8 successively, these points being each identified as the position of the needle hook 20 each time the drive shaft 34 rotates through one/eighth of a revolution. When the drive shaft 34 completes one full revolution, the needle hook 20 is returned to the starting position P1. Thus, the needle hook 20 traces a path as indicated by the dotted line 39 of FIG. 3B in the direction of the arrow heads 40 during a complete cycle of operation of the linkage mechanism 17.

As best shown in FIG. 3B, the needle hook 20 is raised transversely across the level X—X of the fabric during its movement along and between the positions P4 and P6 which define a first or loop-catching position, so that the hook 20 can catch the loop of weft yarn 12 which is projected through the shed 13 by the weft inserting finger 11. Further, in FIG. 3A, the axis of the needle shank 18 coincides sequentially with the lines N1 through N8 during a complete cycle of operation of the mechanism 17, these lines being each utilized to show the position of the needle shank 18 each time the drive shaft 34 rotates through one/eighth of a revolution. At the line Y—Y, the needle shank 18 is held vertically stationary, thereby preventing the up-and-down movement of the previous weft loop on the needle shank 18 at a second or cast-off position, which loop can then be knitted with the next weft loop stably adjacent the fabric fell.

Depending upon the size and type of the loom to be employed, selvage forming knitting needle, and woven structure of the narrow webs, the linkage mechanism 17 can be changed in structure to obtain a desired movement of the needle hook 20. However, it is necessary that the four links be joined together in order to provide a vertically elongated parallelogramatic construction in side elevation, and the needle hook 20 be located just forwardly of the fabric fell at its starting or retracted position. It is also desirable that the link members are interconnected so that the pin 28 will be positioned in substantial, vertical registration with the starting position of the needle hook 20.

Although various minor modifications may be suggested by those versed in the art, it should be understood that I wish to embody within the scope of the patent warrented hereon, all such embodiments as reasonably and properly come within the scope of my contribution to the art.

What is claimed is:

1. A driving mechanism for selvage forming knitting needles in shuttleless looms for producing woven fabrics, comprising:

a. a pair of upper and lower horizontal links;

b. a pair of front and rear vertical links, said upper and lower links and said front and rear links being pivotally joined together to provide a substantially parallelogramatic construction;

c. a first link extension extending from said lower link and adapted to be pivotally coupled to a machine frame;

d. a second link extension extending from said upper link and having mounted thereon a knitting needle which is provided with a hook and a shank and is located alongside of the fabric; and e. means for swinging said links so that said knitting needle is movable between a first position where said hook is raised to engage a loop of weft yarn projected through the shed and a second position where said shank is held vertically stationary adjacent to the fabric fell to knit the loop through the previous loop on the shank when said drive shaft is rotated.

2. A driving mechanism according to claim 1 in which said means is a disk crank having a crank pin rotatably connected to said rear link and adapted to be coupled with a drive shaft of the shuttleless loom.

3. A driving mechanism according to claim 1 in which said upper and lower links and said front and rear links are joined together at their ends by means of pins.

4. A driving mechansim according to claim 3 in which said first link extension is coupled to the machine frame by means of a pin.

5. A driving mechanism according to claim 1 in which said knitting needle is a latch needle.

6. A driving mechanism according to claim 1 in which said hook has a starting position that is in substantial, vertical registration with a position where said first link extension is pivotally coupled to the machine frame.

7. A driving mechansim according to claim 1 in which said hook is located just forwardly of the fabric fell in its starting position.

* * * * *